US008431316B2

(12) United States Patent
Akazawa et al.

(10) Patent No.: US 8,431,316 B2
(45) Date of Patent: Apr. 30, 2013

(54) TONER MANUFACTURING METHOD

(75) Inventors: Yoshiaki Akazawa, Osaka (JP); Yoshitaka Kawase, Osaka (JP); Yoritaka Tsubaki, Osaka (JP); Yoshinori Mutoh, Osaka (JP); Keiichi Kikawa, Osaka (JP); Takashi Hara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 206 days.

(21) Appl. No.: 12/941,581

(22) Filed: Nov. 8, 2010

(65) Prior Publication Data

US 2011/0111338 A1 May 12, 2011

(30) Foreign Application Priority Data

Nov. 9, 2009 (JP) ..... P2009-256576

(51) Int. Cl.
*G03G 9/00* (2006.01)

(52) U.S. Cl.
USPC ..... 430/137.11; 430/137.1

(58) Field of Classification Search ..... 430/109.3, 430/110.1, 110.2, 137.1, 137.11
See application file for complete search history.

(56) References Cited

U.S. PATENT DOCUMENTS

| | | | | |
|---|---|---|---|---|
| 2004/0259017 | A1 | 12/2004 | Shibai et al. | |
| 2008/0166156 | A1 * | 7/2008 | Kawase | 399/222 |
| 2008/0233496 | A1 | 9/2008 | Kotsugai et al. | |
| 2009/0098475 | A1 * | 4/2009 | Yamada et al. | 430/108.4 |
| 2009/0297224 | A1 * | 12/2009 | Kawase et al. | 399/252 |

FOREIGN PATENT DOCUMENTS

| | | |
|---|---|---|
| JP | 05-331215 | 12/1993 |
| JP | 08-171230 | 7/1996 |
| JP | 2005-10672 | 1/2005 |
| JP | 2007-086493 | 4/2007 |
| JP | 2008-191639 | 8/2008 |
| JP | 2008-268872 | 11/2008 |

* cited by examiner

*Primary Examiner* — Stewart Fraser
(74) *Attorney, Agent, or Firm* — Nixon & Vanderhye P.C.

(57) ABSTRACT

A toner manufacturing method is provided. The toner manufacturing method includes a step of adhering fine resin particles whose volume average particle size is 5% or more and 17% or less of a volume average particle size of toner base particles, to surfaces of the toner base particles; and a step of plasticizing the toner base particles and the fine resin particles by adding mechanical impact thereto while spraying lower alcohol, and fusing the fine resin particles to the surfaces of the toner base particles to form a plurality of projections of the fine resin particles, on the surfaces of the toner base particles. Surface coverage of the surfaces of the toner base particles with the projections is 10% or more and 50% or less.

4 Claims, 4 Drawing Sheets

TONER MANUFACTURING METHOD

CROSS-REFERENCE TO RELATED APPLICATION

This application claims priority to Japanese Patent Application No. 2009-256576, which was filed on Nov. 9, 2009, the content of which is incorporated herein by reference in its entirety.

BACKGROUND OF THE INVENTION

1. Field of the Invention

The present invention relates to a toner manufacturing method.

2. Description of the Related Art

In an electrophotographic image forming apparatus, a surface of an image bearing member is charged uniformly by a charging section (charging step), the surface of the image bearing member is exposed by an exposure section, and charges on the exposed surface are dissipated, thereby forming an electrostatic latent image on the surface of the image bearing member (exposure step). Then, a toner which is fine colored powder having charges is adhered to the electrostatic latent image to make a visible image (developing step), and the obtained visible image is transferred onto a recording medium such as paper (transfer step). Further, the visible image is fixed onto the recording medium by a fixing section under application of heat and pressure or with other fixing method (fixing step). Through these steps, an image is formed on the recording medium. Moreover, cleaning of the image bearing member is performed for removing the toner which has not been transferred onto the recording medium and thus remains on the surface of the image bearing member (cleaning step).

In recent years, with trend of improvement in image quality of a full-color image, in order to enhance accuracy of color reproduction by color mixing, an intermediate transfer system in which images of respective colors are sequentially formed on one transfer member while being overlaid on top of one another and the formed full-color images are collectively transferred onto a transfer medium is employed as a transfer method.

Moreover, examples of a method for fixing a toner include a heating fixing method in which a toner is fixed onto a recording medium by melting the toner under application of heat and a pressure fixing method in which a toner is fixed on a recording medium by plastically deforming the toner under application of pressure.

The toner used for such image formation needs to have functions required not only in the developing step but also in each of the transfer step, the fixing step and the cleaning step. For example, the developing step requires sufficient durability against stress caused by stirring in a developer tank and the like, and the transfer step requires high transfer property from a transfer member to a recording medium. In addition, the fixing step requires low-temperature fixation property in terms of energy saving.

In order to realize low-temperature fixation property, molecular weight of a binder resin constituting toner particles is reduced, or a release agent is added to toner particles to reduce a softening temperature of the toner particles. At the same time, it is necessary to prevent occurrence of offset that the composition of the toner remaining on a fixing member is fixed onto a recording medium to contaminate an image.

Meanwhile, in order to enhance transfer property of the toner, for example, the toner is spheroidized, or a spacer is applied to the surface of the toner by adding fine particles whose particle size is around one-tenth to one-thirtieth the particle size of the toner, to the toner.

However, transfer property is enhanced by spheroidizing the toner, but a problem is caused that the toner slips through a blade and contaminates a transfer member to cause a defective image. In addition, fine particles having the size used as a spacer are separated from the toner surface to cause problems such as contamination of the interior of a developer tank or a drum, and a white spot.

In order to solve such problems, Japanese Unexamined Patent Publication JP-A 5-331215 (1993) discloses a spherical toner having a projection formed on the surface of dispersion-polymerized particles to have irregularity on the particle surface. In addition, JP-A 8-171230 (1996) discloses a toner manufacturing method in which at least one kind of fine powder selected from among a chromatic colorant, a flowability improver, an abrasive agent, an electric charge controlling agent, a magnetic substance and inorganic fine particles is adhered to the particle surface of binder resin powder and mechanical impact is allowed to act to keep the fine powder on the particle surface of the binder resin powder by implantation.

However, in the toner disclosed in JP-A 5-331215, a second monomer is polymerized in the dispersion-polymerized particles of a first monomer to thereby form a projection, but a lot of minute projections are formed and it is difficult to form a projection having the size larger than one-twentieth the particle size of toner. Such a toner shows cleaning property enhancing effect to a certain degree by minute projections compared to the spherical toner obtained by a dispersion polymerization method, but does not show sufficient enhancing effect for other toner properties.

Further, in the toner disclosed in JP-A 8-171230, although the fine powder is implanted and kept on the particle surface of the binder resin powder by mechanical impact, the fine powder and the binder resin particles are not attached to each other by fusion, so that the fine powder is easily separated from the toner surface, causing image defects. In addition, by keeping not-hot melt fine powder on the toner surface, hot melting property of toner base particles containing the binder resin powder is affected and a release agent component is inhibited from bleeding out, resulting in lowering in fixation property of the toner.

SUMMARY OF THE INVENTION

An object of the invention is to provide a toner manufacturing method capable of satisfying both high transfer property and cleaning property, without generating loose fine particles which cause image defects and without deteriorating fixation property.

The invention provides a toner manufacturing method, comprising:

a step of adhering fine resin particles whose volume average particle size is 5% or more and 17% or less of a volume average particle size of toner base particles, to surfaces of the toner base particles; and a step of plasticizing the toner base particles and the fine resin particles by adding mechanical impact thereto while spraying lower alcohol, and fusing the fine resin particles to the surfaces of the toner base particles to form a plurality of projections of the fine resin particles, on the surfaces of the toner base particles, surface coverage of the surfaces of the toner base particles with the projections being 10% or more and 50% or less.

According to the invention, since fine resin particles whose volume average particle size is 5% or more and 17% or less of a volume average particle size of toner base particles are adhered to the surfaces of the toner base particles, projections having a suitable size are formed on the surfaces of the toner base particles, thus making it possible to enhance cleaning property of the toner.

Further, since the toner base particles and the fine resin particles are plasticized by spraying lower alcohol, it is possible to attach the fine resin particles to the surfaces of the toner base particles by fusion with little impact. Since the sprayed lower alcohol takes vaporization heat in vaporizing, the toner base particles are not heated to a boiling point of the lower alcohol to be sprayed or higher, even when the toner base particles are heated with impact. Thus, it is possible to form the projections of the fine resin particles on the surfaces of the toner base particles, without causing excessive deformation and aggregation of the toner base particles and the fine resin particles.

Further, since the formed projections are attached sufficiently to the toner base particles by fusion, the projections are not separated from the toner against stress caused by stirring in a developer tank and the like. Thereby, it is possible, to satisfy excellent transfer property and cleaning property of the toner at the same time and obtain a high-definition image, without causing a white spot on a part where the projections are separated, fixing failure and the like.

Further, since surface coverage of the surfaces of the toner base particles with the projections is 10% or more and 50% or less, more than half of the surfaces of the toner base particles is exposed, so that a release agent is able to bleed out sufficiently. Thereby, it is possible to keep releasing property of the toner sufficiently, in particular, at the time of high-temperature fixation.

Further, in the invention, it is preferable that the plurality of projections of the fine resin particles are formed so as not to be attached to each other by fusion.

According to the invention, since the plurality of projections of the fine resin particles are formed so as not to be attached to each other by fusion, a release agent contained in the toner base particles is not inhibited from bleeding out, thus making it possible to keep excellent fixation property and releasing property of the toner.

Further, in the invention, it is preferable that the fine resin particles are polyester or styrene-acrylic copolymer, have a glass transition temperature of 60° C. or higher, and start to flow out in a flow tester at a temperature of 80° C. or higher and 100° C. or lower.

According to the invention, since the fine resin particles are polyester or styrene-acrylic copolymer, have a glass transition temperature of 60° C. or higher, and start to flow out in a flow tester at a temperature of 80° C. or higher and 100° C. or lower, the shapes of the projections of the fine resin particles are kept and fixing failure does not occur due to insufficient melting of the projections in fixing, so that it is possible to keep excellent cleaning property and transfer property of the toner.

Further, in the invention, it is preferable that the fine resin particles are styrene-acrylic copolymer having a crosslinked resin on a surface layer thereof.

According to the invention, since the fine resin particles are styrene-acrylic copolymer having a crosslinked resin on a surface layer thereof, it is possible to satisfy durability and melting property in fixing of the toner at the same time.

Further, the invention provides a toner obtained by the toner manufacturing method mentioned above.

According to the invention, a toner of the invention is obtained by the toner manufacturing method mentioned above, it is possible to satisfy both excellent transfer property and cleaning property of the toner, keep excellent durability, and obtain a high-definition image.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
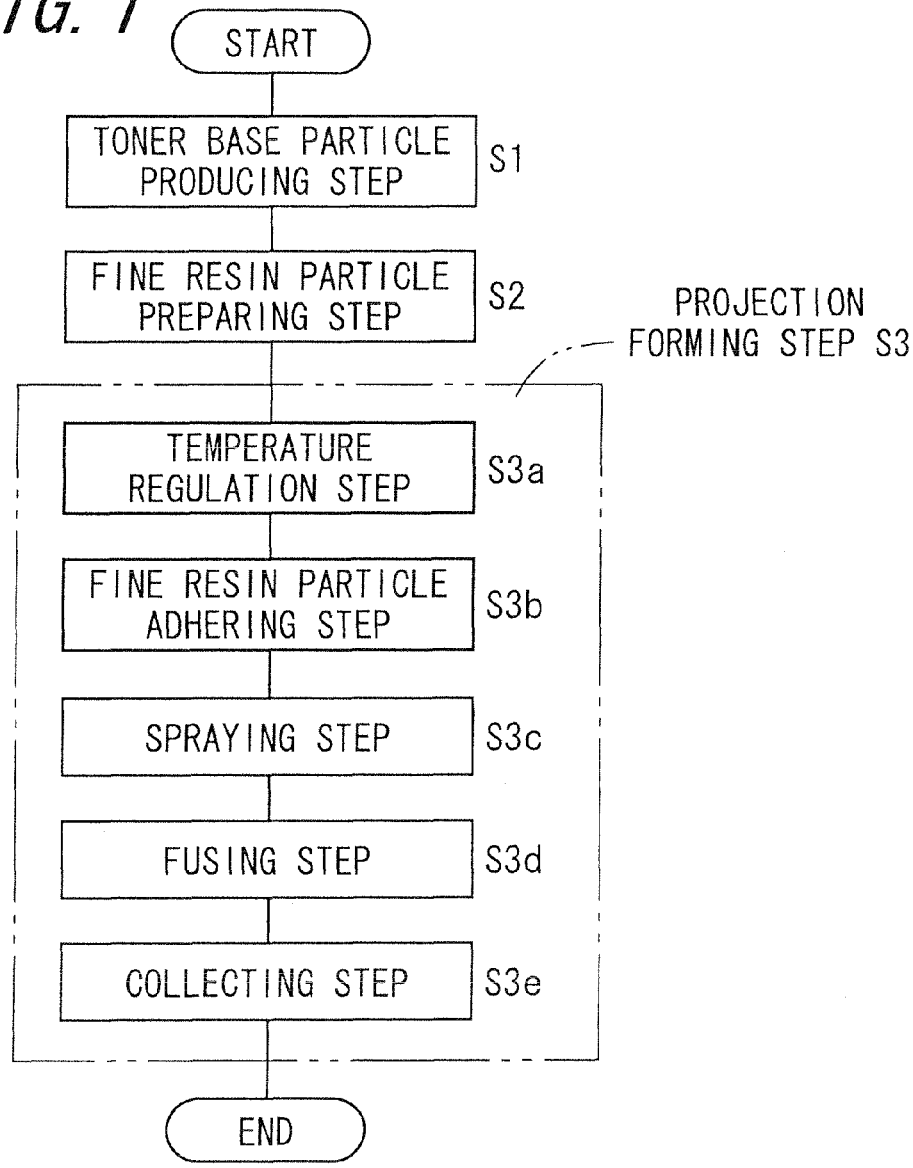
FIG. 1 is a flowchart showing an example of procedures in a toner manufacturing method according to one embodiment of the invention.

Now referring to the drawings, preferred embodiments of the invention are described below.

1. Toner Manufacturing Method

FIG. 1 is a flowchart showing an example of procedures in a toner manufacturing method according to one embodiment of the invention. The toner manufacturing method according to one embodiment of the invention includes a toner base particle producing step S1 of producing toner base particles, a fine resin particle preparing step S2 of preparing fine resin particles, and a projection forming step S3 of forming resin projections of fine resin particles on the surface of toner base particles.

(1) Toner Base Particle Producing Step S1

At the toner base particle producing step S1, toner base particles of which surface resin projections are formed are produced. The toner base particles are particles containing a binder resin, a release agent and a colorant, and are able to be obtained with a known method without particular limitation to a producing method thereof. Examples of the method for producing the toner base particles include dry methods such as pulverization methods, and wet methods such as suspension polymerization methods, emulsion aggregation methods, dispersion polymerization methods, dissolution suspension methods and melting emulsion methods. The method for producing the toner base particles using a pulverization method will be described below.

(Method for Producing Toner Base Particles by a Pulverization Method)

In producing toner base particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner base particles are optionally obtained by conducting adjustment of a particle size such as classification.

Usable mixers include heretofore known mixers including, for example, Henschel-type mixing devices such as HENSCHELMIXER (trade name) manufactured by Mitsui Mining Co., Ltd., SUPERMIXER (trade name) manufactured by Kawata MEG Co., Ltd., and MECHANOMILL (trade name)

manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

As described above, the toner base particles contain the binder resin, the release agent and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used. The binder resin may be used each alone, or two or more of them may be used in combination.

Among the binder resins, polyester is preferable as binder resin for color toner owing to its excellent transparency as well as good powder flowability, low-temperature fixing property, and secondary color reproducibility. For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent and in the presence of the polycondensation catalyst. The polycondensation reaction ends when an acid number, a softening temperature, etc. of the polyester to be produced reach predetermined values. The polyester is thus obtained.

When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible in water may also be used which polyester has a main chain or side chain bonded to a hydrophilic radical such as a carboxyl group or a sulfonate group. Further, polyester may be grafted with acrylic resin.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, and C.I. Pigment Yellow 185.

Examples of orange colorant include red lead yellow, molybdenum orange, permanent orange GTR, pyrazolone orange, vulcan orange, indanthrene brilliant orange RK, benzidine orange G, indanthrene brilliant orange GE, C.I. Pigment Orange 31, and C.I. Pigment Orange 43.

Examples of red colorant include red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53: 1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. Pigment Blue 15, C.I. Pigment Blue 15:2, C.I. Pigment Blue 15:3, C.I. Pigment Blue 16, and C.I. Pigment Blue 60.

Examples of green colorant include chromium green, chromium oxide, pigment green B, malachite green lake, final yellow green G, and C.I. Pigment Green 7.

Examples of white colorant include those compounds such as zinc white, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight or more and 20 parts by weight or less, and more preferably 5 parts by weight or more and 10 parts by weight or less based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into the toner composition at the time of dry-mixing.

As the release agent, it is possible to use ingredients which are customarily used in the relevant field, including, for example, petroleum wax such as paraffin wax and derivatives thereof, and microcrystalline wax and derivatives thereof; hydrocarbon-based synthetic was such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The toner base particles may contain a charge control agent in addition to the binder resin, the release agent and the colorant. For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 parts by weight or more and 3 parts by weight or less is preferably used relative to 100 parts by weight of the binder resin.

The toner base particles obtained at the toner base particle producing step S1 preferably have a volume average particle size of 4 μm or more and 8 μm or less. In a case where the volume average particle size of the toner base particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparing Step S2

At the fine resin particle preparing step S2, dried fine resin particles are prepared. Any method may be used for drying and it is possible to obtain the dried fine resin particles, for example, with methods such as drying of a hot air receiving type, drying of heat transfer by heat conduction type, far infrared radiation drying, and microwave drying. The fine resin particles are used as raw materials for resin projections formed on the surfaces of the toner base particles by fusing, at the subsequent projection forming step S3. By forming the resin projections on the surfaces of the toner base particles, it is possible to prevent, for example, occurrence of blocking due to softening of the binder resin contained in the toner base particles. In addition, since the shape of the fine resin particles remains on the surface of the toner particles in the resin projection, it is possible to obtain toner particles excellent in cleaning property compared to the toner particles whose surface is smooth.

The fine resin particles as described above can be obtained, for example, in a manner that raw materials of the fine resin particles are emulsified and dispersed into fine grains by using a homogenizer or the like machine. Further, the fine resin particles can also be obtained by polymerizing monomers.

In the invention, since the resin projections contain a polyester resin and a styrene-acrylic copolymer resin, polyester fine resin particles of a polyester resin and styrene-acrylic copolymer fine resin particles of a styrene-acrylic copolymer resin are prepared as the fine resin particles. Note that, common properties between polyester fine resin particles and styrene-acrylic copolymer fine resin particles will be described below simply as for "fine resin particles".

A glass transition temperature of the resin used for raw materials of the fine resin particles is preferably higher than a glass transition temperature of the binder resin contained in the toner base particles, and is more preferably 60° C. or higher. Thereby, the shape of the projections is kept and cleaning property of the toner is enhanced.

In addition, a temperature at which the resin used for raw materials of the fine resin particles starts to flow out in a flow tester depends on an image forming apparatus in which the toner is used, but is preferably 80° C. or higher and 100° C. or lower. By using the resin which falls within such a temperature range, it is possible to obtain a toner having both storage stability and fixation property.

A volume average particle size of the fine resin particles is preferably 5% or more and 17% or less of a volume average particle size of the toner base particles. When the volume average particle size of the fine resin particles is 5% or more and 17% or less of the volume average particle size of the toner base particles, projections having a suitable size are formed on the surfaces of the toner base particles. Thereby, the toner manufactured by the method of the invention is easily caught by cleaning blades at the time of cleaning, resulting in enhancement of cleaning property.

As the polyester resin constituting the polyester fine resin particles, the polyester resin used for the binder resin described above may be used.

Examples of the styrene-acrylic copolymer resin constituting the styrene-acrylic copolymer fine resin particles include styrene-acrylic acid methyl copolymer, styrene-acrylic acid ethyl copolymer, styrene-acrylic acid butyl copolymer, styrene-methacrylic acid methyl copolymer, styrene-methacrylic acid ethyl copolymer, styrene-methacrylic acid butyl copolymer, and styrene-acrylonitrile copolymer.

In addition, the styrene-acrylic copolymer resin preferably has a slight crosslink on the surface thereof. Thereby, the surface composition structure of a material of low-temperature-softening fine particles is thermally strengthened, thus making it possible to form the projections without greatly deteriorating thermal property of the entire fine resin particles and with deformation due to thermal impact suppressed. At the same time, it is possible to enhance durability of the toner.

(3) Projection Forming Step S3

<Toner Manufacturing Apparatus>

Figure 2:
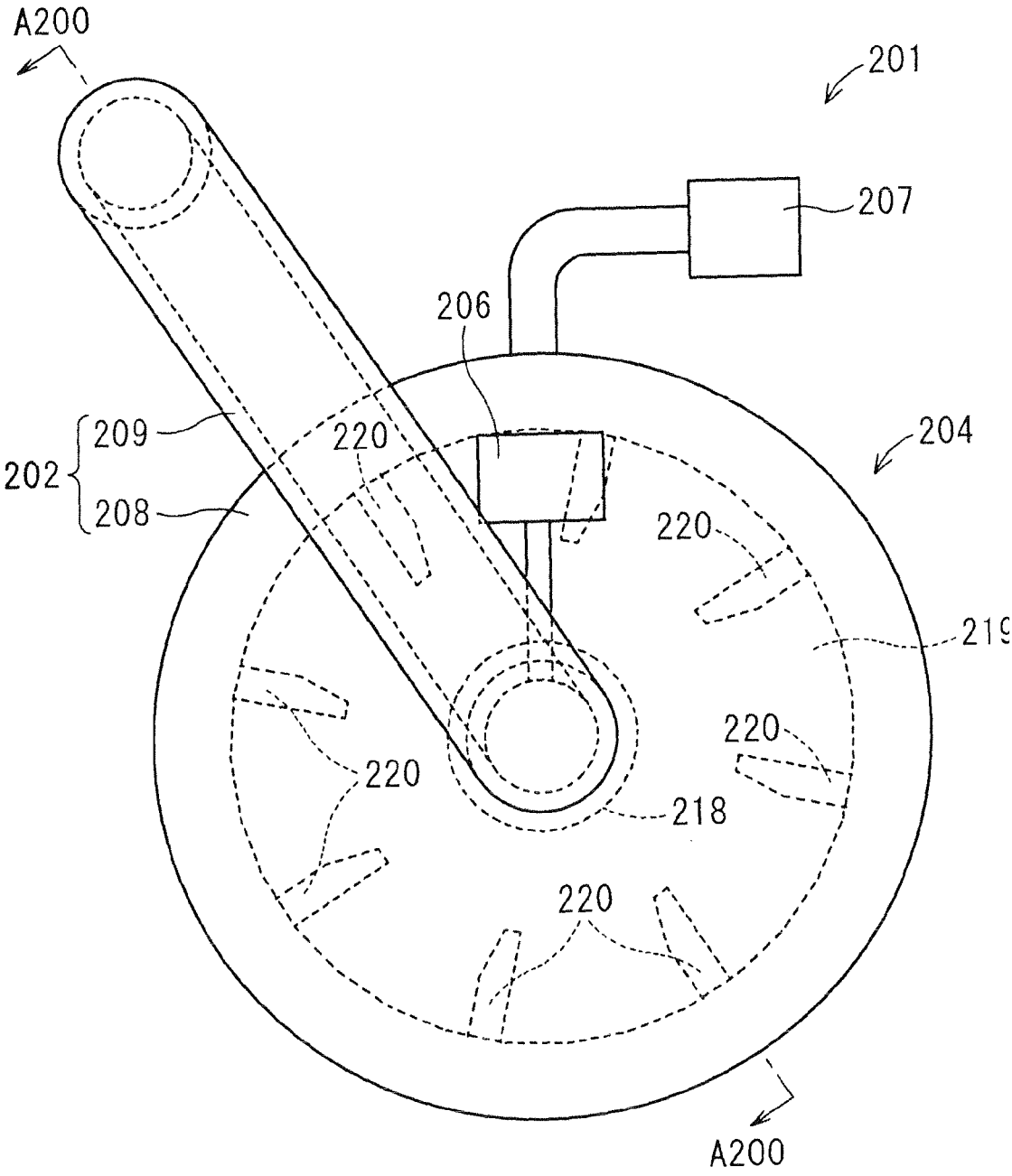
FIG. 2 is a front view of a configuration of a toner manufacturing apparatus used for the toner manufacturing method according to one embodiment of the invention.
Figure 3:
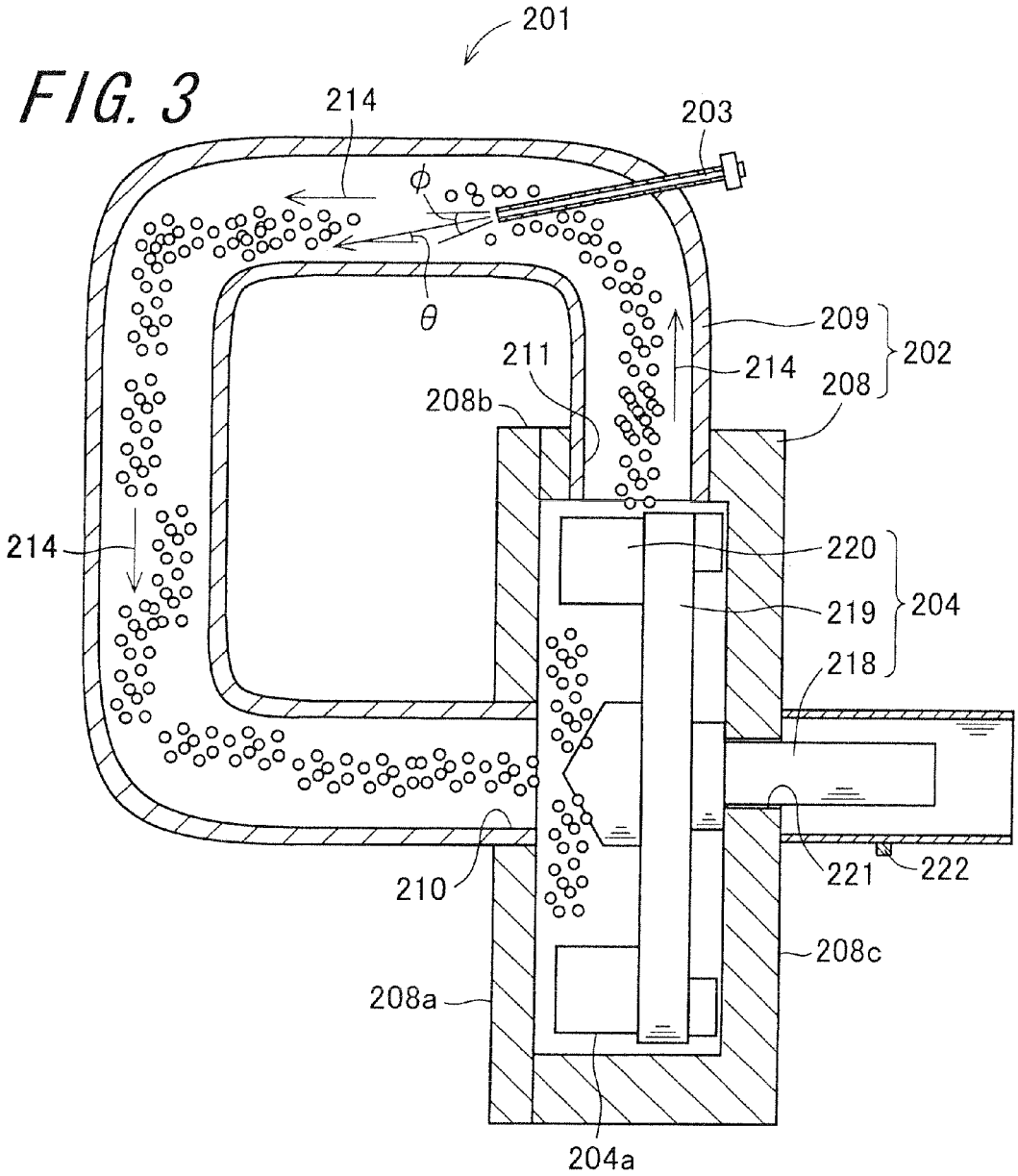
FIG. 3 is a schematic sectional view of the toner manufacturing apparatus shown in FIG. 2 taken along the line A200-A200.

FIG. 2 is a front view of a configuration of a toner manufacturing apparatus 201 used for the toner manufacturing method according to one embodiment of the invention. FIG. 3 is a schematic sectional view of the toner manufacturing apparatus 201 shown in FIG. 2 taken along the line A200-A200. At the projection forming step S3, for example, using the toner manufacturing apparatus 201 shown in FIG. 2, resin projections are formed on the surfaces of the toner base particles by a multiplier effect of circulation and an impact force of stirring in the apparatus. The toner manufacturing apparatus 201 which is a rotary stirring apparatus comprises a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 is comprised of a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of the axial direction of the stirring section 208 so as to penetrate a side wall including the surface 208*a* of the stirring section 208 in the thickness direction. Moreover, the opening section 211 is formed at a side surface 208*b* perpendicular to the surface 208*a* in one side of the axial direction of the stirring section 208 so as to penetrate a side wall including the side surface 208*b* of the stirring section 208 in the thickness direction. The powder flowing section 209 which is a circulation tube has one end connected to the opening section 210 and the other end connected to the opening section 211. Thereby, the internal space of the stirring section 208 and the internal space of the powder flowing section 209 are communicated to form the powder passage 202. The toner base particles, the fine resin particles and gas flow through the powder passage 202. The powder passage 202 is provided so that the powder flowing direction which is a direction in which the toner base particles and the fine resin particles flow is constant.

The temperature in the powder passage 202 is set to not higher than the glass transition temperature of the toner base particles, and is preferably 30° C. or higher and not higher than the glass transition temperature of the toner base particles. The temperature in the powder passage 202 is almost uniform at any part by the flow of the toner base particles. In a case where the temperature in the passage exceeds the glass transition temperature of the toner base particles, there is a possibility that the toner base particles are softened excessively and aggregation of the toner base particles occurs. Further, in a case where the temperature is lower than 30° C., the drying speed of dispersion liquid is made slow and the productivity is lowered. Thus, in order to prevent aggregation of the toner base particles, it is necessary to maintain the temperature of the powder passage 202 and a rotary stirring section 204, which will be described below, at not higher than the glass transition temperature of the toner base particles Thus, a temperature regulation jacket, which will be described below, whose inner diameter is larger than an external diameter of the powder passage tube is disposed at least on a part of the outside of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-hole 221 formed in the other side of the axial direction of the stirring section 208 to penetrate the side wall including the surface 208*c* in the thickness direction, and that is rotated around the axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

At the projection forming step S3, the peripheral speed is preferably set m/sec more in the outermost peripheral of the rotary stirring section 204, and is more preferably set to 50 m/sec or more. The outermost peripheral of the rotary stirring section 204 is a part 204*a* of the rotary stirring section 204 which has the longest distance to the axis of the rotary shaft member 218 in the direction perpendicular to the direction in which the rotary shaft member 218 of the rotary stirring section 204 extends. In a case where the peripheral speed in the outermost peripheral of the rotary stirring section 204 is set to 30 m/sec or more at the time of rotation, it is possible to isolate and fluidize the toner base particles and the fine resin particles. In a case where the peripheral speed in the outermost peripheral is less than 30 m/sec, it is impossible to isolate and fluidize the toner base particles and the fine resin particles, thus making it impossible to uniformly form the resin projections on the surfaces of the toner base particles.

The toner base particles and the fine resin particles preferably collide with a rotary disc 219 vertically. Thereby, the toner base particles and the fine resin particles are stirred sufficiently, thus making it possible to form the resin projections on the surfaces of the toner base particles more uniformly and to further enhance yield of the toner having the uniform projections.

(Spraying Section)

The spraying section 203 is provided so as to be inserted in an opening formed on the outer wall of the powder passage 202, and provided, in the powder flowing section 209, at the powder flowing section on a side closest to the opening section 211 in the flowing direction of the toner base particles and the fine resin particles. The spraying section 203 includes a liquid reservoir for reserving a liquid, a carrier gas supplying section for supplying carrier gas, and a two-fluid nozzle for mixing the liquid and the carrier gas, ejecting the obtained mixture to the toner base particles present in the powder passage 202, and spraying droplets of the liquid to the toner base particles. As the carrier gas, compressed air and the like may be used. The liquid fed to the spraying section 203 by a liquid feeding pump with a constant flow amount and sprayed by the spraying section 203 is gasified, so that the gasified liquid spreads on the surfaces of the toner base particles and the fine resin particles. Thereby, the surfaces of the toner base particles and the fine resin particles are plasticized.

(Temperature Regulation Jacket)

The temperature regulation jacket (not shown) is provided at least on a part of the outside of the powder passage 202 and regulates the temperature in the powder passage 202 and of the rotary stirring section 204 to a predetermined temperature by passing a cooling medium or a heating medium through the internal space of the jacket. Thereby, at a temperature regulation step S3*a*, which will be described below, it is possible to control the temperature in the powder passage 202 and outside the rotary stirring section to a temperature or less at which the toner base particles and the fine resin particles are not softened and deformed. In addition, at a spraying step S3*c* and a fusing step S3*d*, it is possible to reduce a variation in the temperature applied to the toner base particles, the fine resin particles and the liquid, and to keep the stable fluidized state of the base particles to which the fine resin particles are adhered.

In this embodiment, the temperature regulation jacket is preferably provided over the entire outside of the powder passage 202. While the toner base particles and the fine resin particles generally collide with the inner wall of the powder passage many times, at the collision, a part of collision energy is converted into heat energy, and the heat energy is stored in the toner base particles and the fine resin particles. With increasing the number of times of collision, the heat energy stored in those particles is increased, and then the toner base particles and the fine resin particles get soft and adhere to the inner wall of the powder passage. By providing the temperature regulation jacket over the entire outside of the powder passage 202, adhesion force of the toner base particles and the fine resin particles to the inner wall of the powder passage is reduced, and adhesion of the toner base particles to the inner wall of the powder passage 202 due to rapid increase of the temperature in the apparatus is able to be prevented reliably, and the powder passage is able to be suppressed from being narrowed by the toner base particles and the fine resin particles. Accordingly, it is possible to form the resin projections on the surfaces of the toner base particles uniformly and to manufacture a toner excellent in cleaning property with high yield.

Moreover, in the inside of the powder flowing section 209 downstream of the spraying section 203, the sprayed liquid is not dried and is retained, and the drying speed is made slow with an improper temperature and the liquid is easily retained. When the toner base particles are in contact therewith, the toner base particles are easily adhered to the inner wall of the powder passage 202, which is an aggregation generation source of the toner. In the inner wall near the opening section 210, the base particles to which the fine resin particles are adhered that flow into the stirring section 208 collide with the base particles to which the fine resin particles are adhered that fluidize in the stirring section 208 with stirring of the rotary stirring section 204, so that the collided toner base particles are easily adhered to the vicinity of the opening section 210. Accordingly, by providing the temperature regulation jacket in such a part where the toner base particles are easily adhered, it is possible to prevent the toner base particles from being adhered to the inner wall of the powder passage 202 more reliably.

(Powder Inputting Section and Powder Collecting Section)

Figure 4:
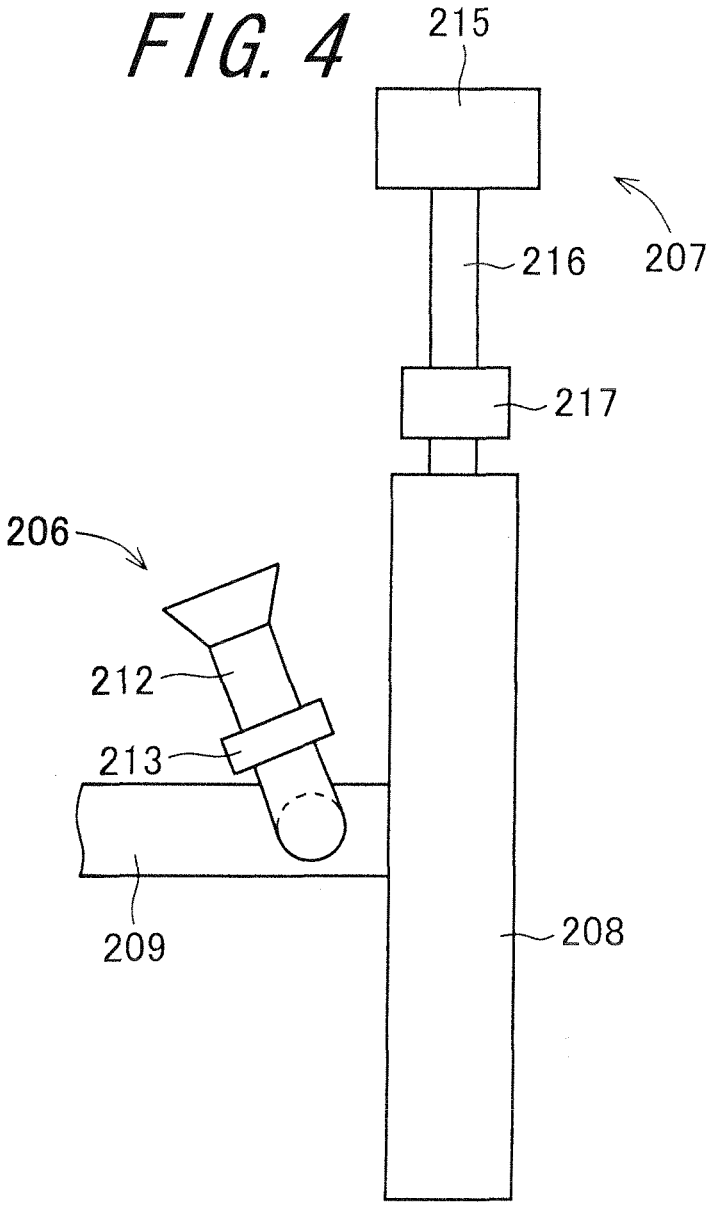
FIG. 4 is a side view of a configuration around a powder inputting section and a powder collecting section.

The powder flowing section 209 of the powder passage 202 is connected to the powder inputting section 206 and the powder collecting section 207. FIG. 4 is a side view of a configuration around the powder inputting section 206 and the powder collecting section 207.

The powder inputting section 206 includes a hopper (not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

(3)-1 Temperature Regulation Step S3*a*

At the temperature regulation step S3*a*, while the rotary stirring section 204 is rotated, temperatures in the powder passage 202 and of the rotary stirring section 204 are regulated to a predetermined temperature by passing a medium through the temperature regulation jacket disposed on the outside thereof. This makes it possible to control the temperature in the powder passage 202 at not higher than a temperature at which the toner base particles and the fine resin particles that are inputted at a fine resin particle adhering step S3*b* described below are not softened and deformed.

(3)-2 Fine Resin Particle Adhering Step S3*b*

At the fine resin particle adhering step S3*b*, the toner base particles and the fine resin particles are supplied from the powder inputting section 206 to the powder passage 202 in a state where the rotary shaft member 218 of the rotary stirring section 204 is rotated, and the fine resin particles are adhered to the surfaces of the toner base particles to obtain base particles to which the fine resin particles are adhered.

(3)-3 Spraying Step S3*c*

At the spraying step S3*c*, the base particles to which the fine resin particles are adhered in a fluidized state are sprayed with a liquid having an effect of plasticizing those particles without dissolving, from the spraying section 203 described above by the carrier gas.

It is preferable that the sprayed liquid is gasified to have a constant gas concentration in the powder passage 202 and the gasified liquid be ejected outside the powder passage through a through-hole 221. Thereby, it is possible to keep the concentration of the gasified liquid in the powder passage 202 constant and to make the drying speed of the liquid higher than the case where the concentration is not kept constant. Thus, it is possible to prevent that the undried toner particles in which the liquid is remained are adhered to other toner particles, to suppress aggregation of the toner particles, and to further enhance yield of the toner particles on which the resin projections are formed uniformly.

The concentration of the gasified liquid measured by a concentration sensor in a gas exhausting section 222 is preferably around 3% or less. In a case where the concentration is around 3% or less, the drying speed of the liquid is able to be increased sufficiently, thus making it possible to prevent adhesion of the undried toner particles in which the liquid is remained to other toner particles and to prevent aggregation of the toner particles. Moreover, the concentration of the gasified liquid is more preferably 0.1% or more and 3.0% or less. In a case where the spraying speed falls within this range, it is possible to prevent aggregation of the toner particles without lowering the productivity.

In this embodiment, it is preferable that the liquid is started to be sprayed after the flow rate of the base particles to which the fine resin particles are adhered is stabilized in the powder passage 202. Thereby, it is possible to uniformly spray the liquid to the base particles to which the fine resin particles are adhered and to enhance yield of the toner on which the resin projections are formed uniformly.

The liquid having an effect of plasticizing the toner base particles and the fine resin particles without dissolving is not particularly limited, but is preferably a liquid that is easily vaporized since the liquid needs to be removed from the toner base particles and the fine resin particles after the liquid is sprayed. An example of the liquid includes a liquid including lower alcohol. Examples of the lower alcohol include methanol, ethanol, and propanol. In a case where the liquid includes such lower alcohol, it is possible to enhance wettability of the fine resin particles as a material of the projection with respect to the toner base particles and adhesion, deformation and fusion of the fine resin particles are easily performed over the entire surface or a large part of the toner base particles. Further, since the lower alcohol has a high vapor pressure, it is possible to further shorten the drying time at the time of removing the liquid and to suppress aggregation of the toner base particles.

Further, the viscosity of the liquid to be sprayed is preferably 5 cP or less. The viscosity of the liquid is measured at 25° C., and can be measured, for example, by a cone/plate type rotation viscometer. A preferable example of the liquid having the viscosity of 5 cP or less includes alcohol. Examples of the alcohol include methyl alcohol, ethyl alcohol and the like. These alcohols have the low viscosity and are easily vaporized, and therefore, when the liquid includes the alcohol, it is possible to spray the liquid with a minute droplet diameter without coarsening a diameter of the spray droplet of the liquid to be sprayed from the spraying section 203. It is also possible to spray the liquid with a uniform droplet diameter. It is possible to further promote fining of the droplet at the time of collision of the toner base particles and the droplet. This makes it possible to uniformly wet the surfaces of the toner base particles and the fine resin particles to apply the liquid to the surface, and soften the fine resin particles by a multiplier effect with collision energy. As a result, it is possible to obtain a toner having excellent uniformity.

An angle θ formed by the liquid spraying direction which is an axial direction of the two-fluid nozzle of the spraying section 203 and the powder flowing direction which is a direction in which the base particles to which the fine resin particles are adhered flow in the powder passage 202 is preferably 0° or more and 45° or less. In a case where the angle θ falls within this range, the droplet of the liquid is prevented from recoiling from the inner wall of the powder passage 202 and yield of the coated toner is able to be further enhanced. In a case where the angle θ exceeds 45°, the droplet of the liquid easily recoils from the inner wall of the powder passage 202 and the liquid is easily retained, thus generating aggregation of the toner particles and deteriorating the yield.

Further, a spreading angle Φ of the liquid sprayed by the spraying section 203 is preferably 20° or more and 90° or less. In a case where the spreading angle Φ falls out of this range, it is likely to be difficult to spray the liquid uniformly to the base particles to which the fine resin particles are adhered.

(3)-4 Fusing Step S3*d*

At the fusing step S3*d*, until the fine resin particles adhered to the toner base particles are softened and fused, the rotary stirring section 204 continues to stir at a predetermined temperature to fluidize the base particles to which the fine resin particles are adhered and attach the fine resin particles to the surfaces of the toner base particles by fusion, thus forming the resin projections.

Here, among projections formed, adjacent projections are formed so as not to be attached to each other by fusion. Thereby, it is possible to keep excellent fixation property and releasing property of the toner without inhibiting the release agent contained in the toner base particles from bleeding out.

Further, surface coverage of the surfaces of the toner base particles with the projections is 10% or more and 50% or less. When more than half of the surfaces of the toner base particles is exposed, the release agent is able to bleed out sufficiently, thus making it possible to keep releasing property of the toner sufficiently, in particular, at the time of high-temperature fixing.

In a case where surface coverage of the surfaces of the toner base particles is less than 10%, it is impossible to reduce a contact area between the surfaces of the toner base particles and a transfer member sufficiently, and sufficient transfer property may not be obtained.

(3)-5 Collecting Step S3*e*

At a collecting step S3*e*, spraying of the liquid from the spraying section and rotation of the rotary stirring section 204 are stopped, and the toner is ejected outside the apparatus from the powder collecting section 207 to be collected.

The configuration of such a toner manufacturing apparatus 201 is not limited to the above and various alterations may be added thereto. For example, the temperature regulation jacket may be provided over the entire outside of the powder flowing section 209 and the stirring section 208, or may be provided in a part of the outside of the powder flowing section 209 or the stirring section 208. In a case where the temperature regulation jacket is provided over the entire outside of the powder flowing section 209 and the stirring section 208, it is possible to prevent the toner base particles from being adhered to the inner wall of the powder passage 202 more reliably.

Further, the toner manufacturing apparatus is also able to be configured by combining a commercially available stirring apparatus and the spraying section. An example of the commercially available stirring apparatus provided with a powder passage and a rotary stirring section includes Hybridization system (trade name) manufactured by Nara Machinery Co., Ltd. By installing a liquid spraying unit in such a stirring apparatus, the stirring apparatus is usable as the toner manufacturing apparatus used for manufacturing a toner of the invention.

2. Toner

A toner according to the embodiment of the invention is manufactured by the toner manufacturing method described above. In the toner obtained by the toner manufacturing method described above, resin projections are formed on the surface of toner base particles and thereby a constituent component of the toner base particles is protected, so that the obtained toner is excellent in durability and storage stability. Further, an image is formed using such a toner, it is possible to obtain an image that is highly-defined with no density unevenness and excellent in image quality.

To the toner of the invention, an external additive may be added. As the external additive, heretofore known substances can be used including silica and titanium oxide. It is preferred that these substances be surface-treated with silicone resin and a silane coupling agent. A preferable usage of the external additive is 1 part by weight to 10 parts by weight based on 100 parts by weight of the toner.

3. Developer

A developer according to an embodiment of the invention includes the toner according to the above embodiment. The developer of the embodiment can be used in form of either one-component developer or two-component developer. In the case where the developer is used in form of one-component developer, only the toner is used without a carrier while a blade and a fur brush are used to effect the fictional electrification at a developing sleeve so that the toner is attached onto the sleeve, thereby conveying the toner to perform image formation. Further, in the case where the developer is used in form of two-component developer, the toner of the above embodiment is used together with a carrier.

As the carrier, heretofore known substances can be used including, for example, single or composite ferrite including iron, copper, zinc, nickel, cobalt, manganese, and chromium; a resin-coated carrier having carrier core particles whose surfaces are coated with coating substances; or a resin-dispersion carrier in which magnetic particles are dispersed in resin.

As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the resistivity of the carrier is preferably $10^8$ Ω·cm or more, and more preferably $10^{12}$ Ω·cm or more.

The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, in the two-component developer, surface coverage of the carrier with the toner is preferably 40% to 80%.

EXAMPLES

Hereinafter, referring to examples and comparative examples, the invention will be specifically described. In the following description, unless otherwise noted, "part" and "%" indicate "part by weight" and "% by weight" respectively. A glass transition temperature and a softening temperature of the resin, a melting point of the release agent, a volume average particle size of the toner base particles, a volume average particle size and a flowing-out starting temperature of the fine resin particles, surface coverage of the surface of the toner base particle with the resin projection in Examples and Comparative Examples were measured as follows.

[Glass Transition Temperature of Resin]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition temperature ($T_g$).

[Softening Temperature of Resin]

Using a flow characteristic evaluation apparatus (trade name: FLOW TESTER CFT-100C, manufactured by Shimadzu Corporation), 1 g of specimen was heated at a temperature increasing rate of 6° C./min, and a load of 20 kgf/cm$^2$ ($19.6\times10^5$ Pa) is applied thereto. A temperature at the time when a half-amount of the specimen was pushed out of a dye (nozzle opening diameter of 1 mm and length of 1 mm) was obtained as the softening temperature ($T_m$).

[Melting Point of Release Agent]

Using a differential scanning calorimeter (trade name: DSC220, manufactured by Seiko Instruments & Electronics Ltd.), 1 g of a specimen was heated from a temperature of 20° C. up to 200° C. at a temperature rising rate of 10° C. per minute, and then an operation of rapidly cooling down from 200° C. to 20° C. was repeated twice, thus measuring a DSC curve. A temperature at an endothermic peak corresponding to the melting on the DSC curve measured at the second operation, served as the melting point of the release agent.

[Volume Average Particle Size of Toner Base Particles]

To 50 ml of an electrolytic solution (trade name: ISOTON-II, manufactured by Beckman Coulter Inc.), 20 mg of a specimen and 1 ml of sodium alkylether sulfate ester were added, and thus-obtained admixture was subjected to dispersion processing of an ultrasonic distributor (trade name: desktop two-frequency ultrasonic cleaner VS-D100, manufactured by AS ONE Corporation) for 3 minutes at a frequency of 20 kHz, which served as a specimen for measurement. As to this specimen for measurement, a particle size distribution measuring apparatus (trade name: Multisizer 3, manufactured by Beckman Coulter Inc.) was used to perform measurement under conditions of an aperture diameter: 100 μm, and the number of particles to be measured: 50,000 counts, and from the volume particle size distribution of the specimen particles, the volume average particle size and a standard deviation in the volume particle size distribution were obtained.

[Volume Average Particle Size of Fine Resin Particles]

Using a particle size analyzer (trade name: Microtrac MT3000, manufactured by Nikkiso Co., Ltd.), a measurement was performed under the conditions of a dispersion medium: water/a refractive index of 1.33, a dipersoid: a refractive index of 1.49, and a volume average particle size was obtained by the volume particle size distribution of the specimen particles.

[Flowing-Out Starting Temperature of Fine Resin Particle]

Using a flow characteristic evaluating device (trade name: FLOW TESTER CET-100C, manufactured by Shimadzu Corporation), 1 g of a specimen was heated at a temperature rising speed of 6 C.° per minute, and a load of 20 kgf/cm$^2$ ($19.6\times10^5$ Pa) was given and the temperature when the specimen was started to flow out from a die (nozzle opening diameter of 1 mm and length of 1 mm) and a displacement of a piston was started was measured to be defined as a flowing-out starting temperature (Ti).

[Surface Coverage of Surface of Toner Base Particle with Resin Projection]

Ten pieces of toner particles were picked out randomly and surfaces thereof were observed by using a scanning electron microscope at a magnification of 5000. An area ratio (%) of a resin projection relative to a surface area of a toner base particle is calculated for the ten pieces of toner base particles, and an average value thereof is defined as surface coverage of the surface of the toner base particle with the resin projection.

Example 1

[Toner Base Particle Producing Step S1]

| | |
|---|---|
| Polyester resin (manufactured by Kao Corporation, glass transition temperature: 60° C., softening temperature: 138° C.) | 85 parts |
| Colorant (C.I. Pigment Blue 15:3) | 5 parts |
| Release agent (trade name: carnauba wax, manufactured by Toa Kasei Co., Ltd., melting point: 82° C.) | 8 parts |
| Charge control agent (trade name: BONTRON E84, manufactured by Orient Chemical Industries Ltd.) | 2 parts |

After pre-mixing the above raw materials by a Henschel mixer for 3 minutes, by using a twin-screw extruder (trade name: PCM-30, manufactured by Ikegai Co., Ltd.), the mixture was melt and kneaded. After being cooled on a cooling belt, the resultant melt-kneaded product was coarsely pulverized by means of a speed mill having a 2-mm-diameter screen, finely pulverized by means of a jet pulverizer (trade name: IDS-2, manufactured by Nippon Pneumatic Mfg. Co., Ltd.), and further classified with an Elbow-Jet classifier (trade name, manufactured by Nittetsu Mining Co., Ltd.), thereby producing toner base particles A (a volume average particle size of 7.0 μm).

[Fine Resin Particle Preparing Step S2]

<Production of Styrene-Acrylic Copolymer Fine Resin Particle>

Styrene, acrylic acid and butyl acrylate were polymerized to obtain styrene-acrylic copolymer fine resin particles A (volume average particle size: 0.4 μm, glass transition temperature: 60° C., flowing-out starting temperature: 92° C.). Thus-obtained fine resin particles for which the water-based suspension was adjusted such that concentration of the fine resin particles was 10 wt % at a weight standard was subjected to dry processing with a spray drier, resulted in fine resin particle powder.

[Projection Forming Step S3]

Into an apparatus in which a two-fluid nozzle was installed in Hybridization system (trade name: NHS-1 Model, manufactured by Nara Machinery Co., Ltd.) in conformity with the apparatus shown in FIG. 2, 100 parts of the toner base particles A and 5 parts of the styrene-acrylic copolymer fine resin particles A were inputted.

The temperature regulation jacket was provided over the entire surface of the powder flowing section and the wall face of the stirring section. A temperature sensor was installed in the powder passage. A temperature of the powder flowing section and the stirring section was regulated to 45° C. In the above-described apparatus, a peripheral speed in the outermost peripheral of the rotary stirring section of the Hybridization system was 100 m/sec at the fine resin particle adhering step to the surface of toner base particles. The peripheral speed was also 100 m/sec at the spraying step and the fusing step. Moreover, an installation angle of the two-fluid nozzle was set so that an angle formed by the liquid spraying direction and the powder flowing direction (hereinafter referred to as "spraying angle") is in parallel (0').

As the liquid spraying unit, one in which a liquid feeding pump (trade name: SP11-12, manufactured by FLOM Co., Ltd.) and a two-fluid nozzle are connected so as to be capable of feeding a liquid at a constant feed rate is able to be used. The liquid spraying speed and the liquid gas exhausting speed are able to be observed by using a commercially-available gas detector (trade name: XP-3110, manufactured by New Cosmos Electric Co., Ltd.).

The toner base particles A and the styrene-acrylic copolymer fine resin particles A which were inputted into the apparatus were retained at a rotation frequency of 8,000 rpm for 5 minutes so that fine resin particles were adhered on the surfaces of the toner base particles, and thereafter, ethanol (EtOH) was sprayed for 15 minutes at a spraying speed of 0.5 g/min and at an air flow rate of 5 L/min, and the fine resin particles were attached to the surfaces of the toner base particles by fusion. After spraying of ethanol was stopped, 5 minutes of stirring was carried out, and a toner of Example 1 was obtained. At this time, an exhaust concentration of the liquid exhausted through a through-hole and the gas exhausting section was stable at 1.4 Vol %. Additionally, the air flow rate to be fed into the apparatus from the rotary shaft section was adjusted to 5 L/min and the air flow rate from the two-fluid nozzle was 5 L/min, and when these values were added together, the air flow rate to be fed into the apparatus was 10 L/min.

<Production of Two-Component Developer>

To 100 parts of the toners of Example 1, 1.0 part a silica fine particle (average particle size: 12 nm) which had been subjected to hydrophobizing treatment was added as external additives, and the resultant admixture was mixed by the Henschel mixer so as to obtain a toner with an external additive. The externally-added toner and a ferrite core carrier with a volume average particle size of 40 μm were mixed so that the toner concentration became 6%, and thus producing a two-component developer of Example 1.

Example 2

At the toner base particle producing step S1, by adjusting the condition of the fine pulverization, toner base particles B (volume average particle size: 8.0 μm) were produced. A toner and a two-component developer of Example 2 were obtained in the same manner as Example 1 except for that 100 parts of the toner base particles B were used instead of the toner base particles A.

Example 3

At the toner base particle producing step S1, by adjusting the condition of the fine pulverization, toner base particles C (volume average particle size: 6.0 μm) were produced. A toner and a two-component developer of Example 3 were obtained in the same manner as Example 1 except for that 100 parts of the toner base particles C were inputted instead of the toner base particles A, and 10 parts of styrene-acrylic copolymer fine resin particles B (volume average particle size: 1.0 μm, glass transition temperature: 58° C., and flowing-out starting temperature: 89° C.) were used instead of the styrene-acrylic copolymer fine resin particles A.

Example 4

A toner and a two-component developer of Example 4 were obtained in the same manner as Example 1 except for that the toner base particles B were used instead of the toner base particles A, and 10 parts of the styrene-acrylic copolymer fine resin particles B were used instead of 5 parts of the styrene-acrylic copolymer fine resin particles A.

Example 5

At the toner base particle producing step S1, each raw material was dissolved into a solvent so that the composition was the same as that of the toner produced by the pulverization method, and with the dissolution suspension method, almost spherical toner base particles D (volume average particle size: 6.0 μm) were produced. A toner and a two-component developer of Example 5 were obtained in the same manner as Example 1 except for that 100 parts of the toner base particles D were used instead of the toner base particles A, and 6 parts of styrene-acrylic copolymer fine resin particles C (volume average particle size: 0.6 μm, glass transition temperature: 61° C., and flowing-out starting temperature: 90° C.) were used instead of the styrene-acrylic copolymer fine resin particles A.

Example 6

A toner and a two-component developer of Example 6 were obtained in the same manner as Example 1 except for that 5 parts of surface slightly crosslinked styrene-acrylic copolymer fine resin particles D (volume average particle size: 0.4 μm, glass transition temperature: 64° C., and flowing-out starting temperature: 100° C.) were used instead of the styrene-acrylic copolymer fine resin particles A. The surface slightly crosslinked styrene-acrylic copolymer was formed by further adding a predetermined amount of a constituent monomer, a crosslinking agent, and a polymerization initiator to emulsion polymerization fine resin particles.

Example 7

<Production of Polyester Fine Resin Particles A>

A polyester resin was dissolved into methyl ethyl ketone, and the solution was mixed with a 1N aqueous ammonia solution, which was emulsified with a mechanical disperser (trade name: CLEARMIX, manufactured by M Technique Co., Ltd.). From the obtained emulsified product, methyl ethyl ketone was depressurized and distilled, thereby obtaining polyester fine resin particles A (volume average particle size: 0.4 μm, glass transition temperature: 55° C. and flowing-out starting temperature: 80° C.). A toner and a two-component developer of Example 7 were obtained in the same manner as Example 1 except for that 5 parts of the polyester fine resin particles A were used instead of the styrene-acrylic copolymer fine resin particles A.

Example 8

A toner and a two-component developer of Example 8 were obtained in the same manner as Example 1 except for that an input amount of the styrene-acrylic copolymer fine resin particles A was 3 parts.

Example 9

A toner and a two-component developer of Example 9 were obtained in the same manner as Example 1 except for that an input amount of the styrene-acrylic copolymer fine resin particles A was 12 parts.

Example 10

A toner and a two-component developer of Example 10 were obtained in the same manner as Example 1 except for that methanol (MeOH) was used instead of ethanol at the projection forming step S3.

Example 11

A toner and a two-component developer of Example 11 were obtained in the same manner as Example 1 except for that 5 parts of styrene-acrylic copolymer fine resin particles G (volume average particle size: 0.4 μm, glass transition temperature: 82° C. and flowing-out starting temperature: 126° C.) were used instead of the styrene-acrylic copolymer fine resin particles A.

Example 12

A toner and a two-component developer of Example 12 were obtained in the same manner as Example 1 except for that 5 parts of polyester fine resin particles B (volume average particle size: 0.4 μm, glass transition temperature: 50° C. and flowing-out starting temperature: 78° C.) were used instead of the styrene-acrylic copolymer fine resin particles A.

Comparative Example 1

A toner and a two-component developer of Comparative Example 1 were obtained in the same manner as Example 1 except for that ethanol was not sprayed at the projection forming step S3.

Comparative Example 2

A toner and a two-component developer of Comparative Example 2 were obtained in the same manner as Example 1 except for that an input amount of the styrene-acrylic copolymer fine resin particles A was 15 parts.

Comparative Example 3

A toner and a two-component developer of Comparative Example 3 were obtained in the same manner as Example 1 except for that 5 parts of styrene-acrylic copolymer fine resin particles E (volume average particle size: 0.2 μm, glass transition temperature: 58° C. and flowing-out starting temperature: 96° C.) were used instead of the styrene-acrylic copolymer fine resin particles A.

Comparative Example 4

A toner and a two-component developer of Comparative Example 4 were obtained in the same manner as Example 1 except for that 4 parts of styrene-acrylic copolymer fine resin particles F (volume average particle size: 1.5 μm, glass transition temperature: 63° C. and flowing-out starting temperature: 97° C.) were used instead of the styrene-acrylic copolymer fine resin particles A.

Comparative Example 5

A toner and a two-component developer of Comparative Example 5 were obtained in the same manner as Example 1 except for that an input amount of the styrene-acrylic copolymer fine resin particle A was 1 part.

Comparative Example 6

A toner and a two-component developer of Comparative Example 6 were obtained in the same manner as Example 1 except for that toner base particles C were used instead of the toner base particles A, and only the toner base particles C were inputted at the projection forming step S3 without using the fine resin particles.

Toners of Examples 1 to 12 and Comparative Examples 1 to 6 were evaluated as follows.

(Output of Image for Evaluation)

Each of the two component developers of Examples 1 to 8 and Comparative Examples 1 to 5 was filled in a commercially available full-color copier of a tandem-type comprising an intermediate transfer device (trade name: MX-3500G, manufactured by Sharp Corporation), and an image was output by adjusting an amount of development so that an attachment amount of a toner was 0.45 mg/cm$^2$ on the drum. As a sheet to be transferred, a commercially available A4 sheet (basis weight: 80 g/m$^2$) was used and a chart including a solid section of 20% and characters (coverage: 25%) was regarded as an image for evaluation.

[Transfer Property]

An image for evaluation without passing through the fixing process and being in an unfixed state was taken out, and a toner on the sheet surface was sucked through a powder duct filter which had been weighed in advance. The weight of the toner captured by the filter was weighed and was divided by the weight of the toner which had been developed on the drum, and thus calculating a transfer ratio. Measurement was performed 5 times for each sample and an average value thereof was regarded as transfer efficiency (%), and evaluations were performed with the following standard.

Good (Favorable): Transfer efficiency is 95% or more.

Not bad (Practicable): Transfer efficiency is 85% or more and less than 95%.

Poor (No good): Transfer efficiency is less than 85%.

[Image Quality and Fixation Property]

The image for evaluation as described above was fixed by using an external fixing apparatus (heating roller diameter and pressure roller diameter: a diameter of 50 mm) provided with the fixing process which is the same as that of the output machine. Fixation was performed at a surface temperature of the fixing section of 160° C. and at a process speed of 167 mm/sec.

Presence/absence of a defect such as a white spot or a character breaking-off in the solid section and the character section of the image for evaluation was observed visually and by a loupe, and thus image quality was evaluated with the following standard.

Good (Favorable): There is no image defect.

Not bad (Practicable): Although there is an image defect partially, it is not visually identifiable.

Poor (No good): An image defect is visually identifiable apparently.

Furthermore, the image for evaluation was folded such that the solid section which had passed through around the center of the fixing section came inside thereof, and the pressure roller of 1 kg was reciprocated thereon for three times, and thereafter the folded section was opened and brushed lightly with a brush, and subsequently a line width of the image section which came off was measured to obtain a maximum value among the measured line widths. Further, presence/absence of reflection of an image and an image roughness (offset) on a part where the fixing roller in the second rotations passed through was confirmed and the fixation property was evaluated with the following standard.

Good (Favorable): The maximum value of the line width of the image section which came off is less than 0.3 mm, and there is no offset.

Not bad (Practicable): The maximum value of the line width of the image section which came off is 0.3 mm or more and 0.5 mm or less, and there is no offset.

Poor (No good): The maximum value of the line width of the image section which came off is more than 0.5 mm, or there is occurrence of an offset.

[Cleaning Property]

Similar evaluation machine was used and a document whose coverage was 5% was printed for 10,000 sheets. At the time, presence/absence of an image defect such as a streak or a band which occurs by the cleaning failure was confirmed and the evaluation was performed with the following standard.

Good (Favorable): No image defect.

Not bad (Practicable): A very short line-like slight streak was found on several sheets of documents, however, was disappeared quickly.

Poor (No good): An image defect such as a streak or a band occurred intermittently or continuously.

[Comprehensive Evaluation]

Comprehensive evaluation was performed with the following standard on the basis of the evaluation results of the transfer property, the image quality, the fixation property, and the cleaning property.

Good (Favorable): All of the results rate as "Good".

Not bad (Practicable): Any of the results rate as "Not bad", but not as "Poor".

Poor (No good): Any of the results rate as "Poor".

Toners of Examples 1 to 12 and Comparative Examples 1 to 6 and the evaluation result of each toner are shown in Table 1 and Table 2, respectively.

TABLE 1

| | Toner base particle | | Fine resin particle | | | | | | Surface | |
|---|---|---|---|---|---|---|---|---|---|---|
| | Type | Particle size (μm) | Type | Particle size (μm) | Glass transition temperature (° C.) | Flowing-out starting temperature (° C.) | Input amount (part) | Particle size ratio (Fine resin particle/Base particle, %) | coverage of toner base particle (%) | Spraying of alcohol |
| Ex. 1 | A | 7 | Styrene-acryl A | 0.4 | 60 | 92 | 5 | 6 | 19 | EtOH |
| Ex. 2 | B | 8 | Styrene-acryl A | 0.4 | 60 | 92 | 5 | 5 | 23 | EtOH |
| Ex. 3 | C | 6 | Styrene-acryl B | 1 | 58 | 89 | 10 | 17 | 13 | EtOH |
| Ex. 4 | B | 8 | Styrene-acryl B | 1 | 58 | 89 | 10 | 13 | 19 | EtOH |
| Ex. 5 | D | 6 | Styrene-acryl C | 0.6 | 61 | 90 | 6 | 10 | 19 | EtOH |
| Ex. 6 | A | 7 | Crosslinked styrene-acryl D | 0.4 | 64 | 100 | 5 | 6 | 20 | EtOH |
| Ex. 7 | A | 7 | Polyester A | 0.4 | 55 | 80 | 5 | 6 | 18 | EtOH |
| Ex. 8 | A | 7 | Styrene-acryl A | 0.4 | 60 | 92 | 3 | 6 | 10 | EtOH |
| Ex. 9 | A | 7 | Styrene-acryl A | 0.4 | 60 | 92 | 12 | 6 | 50 | EtOH |
| Ex. 10 | A | 7 | Styrene-acryl A | 0.4 | 60 | 92 | 5 | 6 | 21 | MeOH |
| Ex. 11 | A | 7 | Styrene-acryl G | 0.4 | 82 | 126 | 5 | 6 | 16 | EtOH |
| Ex. 12 | A | 7 | Polyester B | 0.4 | 50 | 78 | 5 | 6 | 22 | EtOH |
| Comp. Ex. 1 | A | 7 | Styrene-acryl A | 0.4 | 60 | 92 | 5 | 6 | 20 | Not performed |
| Comp. Ex. 2 | A | 7 | Styrene-acryl A | 0.4 | 60 | 92 | 15 | 6 | 68 | EtOH |
| Comp. Ex. 3 | A | 7 | Styrene-acryl E | 0.2 | 58 | 96 | 5 | 3 | 44 | EtOH |
| Comp. Ex. 4 | A | 7 | Styrene-acryl F | 1.5 | 63 | 97 | 4 | 21 | — | EtOH |
| Comp. Ex. 5 | A | 7 | Styrene-acryl A | 0.4 | 60 | 92 | 1 | 6 | 5 | EtOH |
| Comp. Ex. 6 | C | 6 | — | — | — | — | — | — | — | EtOH |

TABLE 2

| | Transfer property | Image quality | Fixation property | Cleaning property | Comprehensive evaluation |
|---|---|---|---|---|---|
| Ex. 1 | Good | Good | Good | Good | Good |
| Ex. 2 | Good | Good | Good | Good | Good |
| Ex. 3 | Good | Good | Good | Good | Good |
| Ex. 4 | Good | Good | Good | Good | Good |
| Ex. 5 | Good | Good | Good | Good | Good |
| Ex. 6 | Good | Good | Good | Good | Good |
| Ex. 7 | Not bad | Good | Good | Good | Not bad |
| Ex. 8 | Good | Good | Good | Good | Good |
| Ex. 9 | Good | Good | Good | Good | Good |
| Ex. 10 | Good | Good | Good | Good | Good |
| Ex. 11 | Good | Not bad | Not bad | Good | Not bad |
| Ex. 12 | Not bad | Good | Not bad | Not bad | Not bad |
| Comp. Ex. 1 | Not bad | Good | Poor | Not bad | Poor |
| Comp. Ex. 2 | Not bad | Good | Poor | Not bad | Poor |
| Comp. Ex. 3 | Not bad | Not bad | Poor | Poor | Poor |
| Comp. Ex. 4 | Poor | Poor | — | — | Poor |
| Comp. Ex. 5 | Not bad | Not bad | Good | Poor | Poor |
| Comp. Ex. 6 | Not bad | Not bad | Good | Poor | Poor |

In the toners of Examples 1 to 6 and 8 to 11, all the evaluations rated as "Good", therefore the transfer property and the cleaning property were satisfied at the same time, the excellent fixation property was obtained, and a high definition image was able to be obtained.

In the toner of Example 7, the transfer property was not so favorable as the toners of Examples 1 to 6 and 8 to 10, and the comprehensive evaluation rated as "Not bad".

In the toner of Example 11, the transfer property and the cleaning property were favorable, however, the image quality and the fixation property were not so favorable as the toners of Examples 1 to 6 and 8 to 10, and the comprehensive evaluation rated as "Not bad".

In the toner of Example 12, the transfer property, the fixation property and the cleaning property were not so favorable as the toners of Examples 1 to 6 and 8 to 10, and the comprehensive evaluation rated as "Not bad".

In the toners of Comparative Examples 1 and 2, the image quality was favorable, however, the fixation property was no good. This is considered because in the toner of Comparative Example 1, the formed projection was not fully attached to the toner base particles by fusion since lower alcohol was not sprayed. In the toner of Comparative Example 2, it is considered such a result was caused by which the surfaces of the toner base particles were not sufficiently exposed.

In the toner of Comparative Example 3, the fixation property and the cleaning property were no good. This is considered because the volume average particle size of the fine resin particles relative to the toner base particles was small, and thus the projection of a suitable size was not formed.

In the toner of Comparative Example 4, the transfer property and the image quality were no good, and according to the observation by using the scanning electron microscope, the fine resin particles were hardly attached to the toner base particles by fusion but separated therefrom in the toner of Comparative Example 4. This is considered because the ratio of the volume average particle size of the fine resin particles relative to the toner base particles was great.

In the toners of Comparative Examples 5 and 6, the fixation property was favorable, however, the cleaning property was no good. This is considered because the surface coverage of the toner base particle with the resin projection was low in the toner of Comparative Example 5, and the resin projection was not included in the toner of Comparative Example 6.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner manufacturing method, comprising:

a step of adhering fine resin particles whose volume average particle size is 5% or more and 17% or less of a volume average particle size of toner base particles, to surfaces of the toner base particles; and a step of plasticizing the toner base particles and the fine resin particles by adding mechanical impact thereto while spraying lower alcohol, and fusing the fine resin particles to the surfaces of the toner base particles to form a plurality of projections of the fine resin particles, on the surfaces of the toner base particles, surface coverage of the surfaces of the toner base particles with the projections being 10% or more and 50% or less.

2. The toner manufacturing method of claim 1, wherein the plurality of projections of the fine resin particles are formed so as not to be attached to each other by fusion.

3. The toner manufacturing method of claim 1, wherein the fine resin particles are polyester or styrene-acrylic copolymer, have a glass transition temperature of 60° C. or higher, and start to flow out in a flow tester at a temperature of 80° C. or higher and 100° C. or lower.

4. The toner manufacturing method of claim 3, wherein the fine resin particles are styrene-acrylic copolymer having a crosslinked resin on a surface layer thereof.

* * * * *